US006308780B1

(12) United States Patent
Efimkin

(10) Patent No.: US 6,308,780 B1
(45) **Date of Patent: *Oct. 30, 2001**

(54) METHOD FOR REGAINING MUD CIRCULATION IN OPERATING WELL AND DEVICE FOR ITS EMBODIMENT

(76) Inventor: Alexei Alexeevich Efimkin, Russian Federation, Respublika Komi, Usinsk, ulitsa Pripolyarnaya, 10, kv. 75, Usinsk (RU)

( * ) Notice: Subject to any disclaimer, the term of this patent is extended or adjusted under 35 U.S.C. 154(b) by 0 days.

This patent is subject to a terminal disclaimer.

(21) Appl. No.: 08/107,832

(22) PCT Filed: Dec. 1, 1992

(86) PCT No.: PCT/RU92/00223

§ 371 Date: Aug. 24, 1993

§ 102(e) Date: Aug. 24, 1993

(87) PCT Pub. No.: WO93/13292

PCT Pub. Date: Jul. 8, 1993

(30) Foreign Application Priority Data

Dec. 28, 1991 (RU) ..... 5026133
Apr. 16, 1992 (RU) ..... 5037858

(51) Int. Cl.[7] ..... E21B 37/02
(52) U.S. Cl. ..... 166/311; 166/173; 166/222
(58) Field of Search ..... 166/311, 312, 166/170, 173, 222

(56) References Cited

U.S. PATENT DOCUMENTS

| | | | | |
|---|---|---|---|---|
| 1,272,253 | * | 7/1918 | Green | 166/173 |
| 1,410,827 | * | 3/1922 | Muehl | 166/312 |
| 2,870,845 | * | 1/1959 | Tripplehorn | 166/170 |
| 3,044,552 | * | 7/1962 | Claiborne | 166/170 |
| 3,176,771 | * | 4/1965 | Claiborne et al. | 166/173 |
| 4,088,191 | | 5/1978 | Hutchinson . | |
| 4,456,064 | * | 6/1984 | Ford | 166/173 |
| 4,479,538 | * | 10/1984 | Coyle, Sr. | 166/173 |
| 4,518,041 | | 5/1985 | Zublin . | |
| 4,705,107 | | 11/1987 | Council et al. . | |
| 4,747,452 | | 5/1988 | Clark . | |
| 4,919,204 | | 4/1990 | Baker . | |

FOREIGN PATENT DOCUMENTS

| | | |
|---|---|---|
| 1465545 | 3/1989 | (RU) . |
| 1686131 | 10/1991 | (RU) . |

* cited by examiner

*Primary Examiner*—Ramon S. Britts
*Assistant Examiner*—Frank S. Tsay
(74) *Attorney, Agent, or Firm*—Lilling & Lilling

(57) ABSTRACT

Run into a well, e.g., in a tube, on a pipe string is a hydromechanical cleaner. The bridge is washed out by the direct desending flow of drilling mud pumped through the pipe string 2. The cleaner is moved downward as the bridge is washed out by moving the pipe string. Ascending flow of drilling mud rotates cleaning heads in opposite directions. Cutting knives of the cleaning heads mechanically remove deposits from the walls of tubing 1. Deposits from the walls are removed mechanically during running of the cleaner into the well and during its lifting from the well. Products of the washed out bridge and deposits are removed from the well by an ascending flow through the side branch pipe of the wellhead circulating head. The device for embodiment of the method includes also a mechanism for moving the pipe string and a pump unit.

9 Claims, 3 Drawing Sheets

METHOD FOR REGAINING MUD CIRCULATION IN OPERATING WELL AND DEVICE FOR ITS EMBODIMENT

FIELD OF THE INVENTION

The offered invention relates to the technical means applicable in removal of sludge, sand and other bridges occuring in operating wells in production of oil, gas or condenate.

DESCRIPTION OF THE PRIOR ART

In the course of well operation, sludge, sand or some other bridges may form in tubing that leads to loss of drilling mud circulation and, hence, to stoppage of product recovery.

Various methods and devices are used for regaining drilling mud circulation.

Known in the art are a method and a device for cleaning tubing. According to a known method a hydromechanical cleaner is run into the well on a pipe string to act on bridge and deposits on tubing walls by direct flow of drilling mud injected through the pipe string and a hydromechanical cleaner. The latter is moved down as the bridge and deposits are washed out and removed mechanically from tubing walls by rotating scraper elements of the hydromechanical cleaner. Products of cleaning are removed from the well by the ascending flow of the drilling mud. A device for embodiment of the known method has a branch pipe with an axial channel and a threaded element in its upper part for connection to a pipe string. A hydro mechanical cleaner is made in the form of scraper elements mounted on its body. The body, in its turn, is installed on the branch pipe concentrical to the latter so as to provide a possibility of rotating under the action of a drive. The body lower portion is furnished with jet nozzles arranged at different angles to the body's longitudinal axis and are hydraulically communicated with a branch pipe axial channel and fulfilling also the function of a drive rotating the body, as the body rotates under the effect of outflow of drilling mud through jet nozzles. There are a mechanism for displacement of the pipe string, a pump unit and a wellhead circulating head. Used in the given known technical solution is a continuous pipe string (U.S. Pat. No. 4,919,204).

Known in the art is a method for regaining drilling mud circulation in a well, comprising running of a hydromechanical cleaner into the well on a pipe string, jetting action on a bridge by direct flow of drilling mud forced through the pipe string and hydromechanical cleaner, motion of the latter as the dridge is washed out, mechanical removal of deposits from well walls by rotating scraper elements of the hydromechanical cleaner and disposal of products of cleaning from the well by; ascending flow of the drilling mud.

A device for embodiment of the known method includes a body with an axial channel and a threaded element in its upper portion to connect a pipe string, and a hydromechanical cleaner in the form of scraper elements installed on the body (USSR patent No. 1,465,545).

A drawback of the known method is its low efficiency, as rotation of scraper elements is effected by rotation of the whole pipe string. The process of removal of washed out bridge particles by the ascending mud flow is also complicated, because the scraper elements block the annulus and resist mud flow.

Known in the art is a method for regaining mud circulation, comprising running into a well of a hydromechanical cleaner on a pipe string, jetting action on wall deposits by direct flow of drilling mud pumped through the pipe string and the hydromechanical cleaner, motion of the latter as the bridge is destroyed and deposits are washed out, mechanical removal of deposits from well walls, breakage of the bridge by rotating scrpaer elements of the hydromechanical cleaner and removal of cleaned products from the well by the ascending flow of the drilling mud. A device for embodiment of the known method includes a hydromechanical cleaner in the form of scraper elements installed on its body, with the latter having its upper portion to connect a pipe string, a mechanism for moving the pipe string, a pump unit and a wellhead circulating head equipped with power slips and a sealing unit. There is means for making a pipe string from separate pipe sections when running it into a well and its breaking into separate sections when the pipe string is withdrawn from the well (U.S. Pat. No. 4,088,191).

A drawback of the known method is its low efficiency as it requires building up a significant pressure drop in mud, acros jet nozzles and rather high hydraulic resistance. Jetting action of the drilling mud on the bridge is not attainable. The bridge can be removed only by mechanical action of scraper elements. Furthermore, rotation of scraper elements is possible only by rotation of the whole pipe string. A device for embodiment of the known method is characterized by a complicated design and does not provide for performance of operations involved in regaining mud circulation under conditions of possible oil or gas formation exposure in removal of bridges, e.g., in tubing because of the design of the wellhead circulating head that does not allow holding of the string from its forcing out in the course of making connections.

Used as a prior art method is a method described in the USSR patent No. 1,465,545, and used as a prior art device is that described by the U.S. Pat. No. 4,088,191.

SUMMARY OF THE INVENTION

It is an object of the offered technical solution to develop an efficient method for regaining drilling mud circulation in a well by removal of sludge, sand and other bridges and deposits and to effect a device for embodiment of said method.

Realization of the offered technical solution makes it possible to enhance the efficiency of the known method due to more complete removal of cleaned products and higher quality of well wall cleaning or cleaning of tubing walls from deposits. Provision is also made to use the offered technical solution in case of deadling, both, with a pipe string formed of separate sections and with a continuous pipe string.

The method for regaining well mud circulation comprises running of a hydromechanical cleaner into a well on a pipe string; jetting action on the bridge by direct flow of drilling mud pumped through the pipe string and the hydromechanical cleaner; motion of the latter as the bridge is washed out; mechanical removal of deposited sludge from well walls by rotating scraper elements of the hydromechanical cleaner; and removal of products of cleaning by ascending flow of mud, whereby scraper elements of the hydromechanical cleaner are rotated to separate deposits from well walls by the ascending flow of drilling mud; and mechanical removal of deposits from well walls is accomplished during running of the hydromechanical cleaner into the well and its lifting out of the well.

The device for regaining well mud circulation comprises a hydromechanical cleaner in the form of scraper elements installed on the cleaner body provided with an axial channel and made so as to connect its top partion to a pipe string; a mechanism for motion of the pipe string; a pump unit for injection of drilling mud into the pipe string; and a wellhead circulating head; the scraper elements of the hydromechanical cleaer are made in the form of at least two cleaning heads with cutting knives on their outer surface installed so as to provide their free rotation in the opposite directions relative to each other in flow of mud.

Accomplishment of the object of the invention is promoted by the fact that a preferred embodiment of the device design comprises cutting knives of an involute profile which has in the upper portion of the cleaning head and the lower portion of the cleaning head cutting edges, and the height of each cleaning head is determined by the relation:

$$H=D/2tg\alpha$$

where H is the height of the cleaning head;
D is the diameter of the cleaning head; α (is the angle of inclination of the cutting knife relative to the longitudinal axis of the cleaning head (angle of the knife).

In a preferred embodiment, the cleaning heads are installed on the body and supported in bearings, which are located in the end faces of cleaning elements and covered from the outside by means of protective skirts. The protective skirts between the lower end face of the upper cleaning head and the upper end face of the lower cleaning head are made on a separating sleeve, arranged between the cleaning heads. The protective skirt covering the bearing found in the annular recess of the upper and face of the upper cleaning head is made in the body. The protective skirt covering the bearing located in the annular recess of the lower end face of the lower cleaning head is made in a removable support fixed in the lower part of the body. The separating sleeve has its outer diameter which is smaller than the outer diameter of the cleaning head, and the body lower portion is provided with an outer thread for joining the removable support by means of a nut with a lock washer.

When use is made of a pipe string formed of separate pipe sections, the wellhead circulating head in the preferred embodiment may be made in the form of a body with its base having a flange, a pressing nut and a cover successively arranged and interconnected, so that they can be disassembled and adjusted in height with respect to each other. Slips are installed with their lower portions in a ring to radially move relative to the latter and with the possibility of synchronous axial displacement together with it in a taper recess of the cover. A sealing unit is found in the base above a side branch, and the pressing nut has a taper recess reverse to the cover taper recess. The ring is spring-loaded relative to the pressing nut. Installed between the spring and the pressing nut is a thrust washer made in the form of a ring interchangeable with the ring connecting the slips. The slips are made so that they may be reinstalled into the thrust washer to be arranged in a taper recess of the pressing nut and have internal bevels in the upper portions.

The sealing unit may be made in the form of a seal located between the upper and lower bearing disks, collars installed between the lower bearing disk and the base, and a box installed on the upper bearing disk with the possibility to interact with the pressing nut. The wellhead circulating head has a ring with outer radial T-shaped recesses and the slips are made with T-shaped shanks in their lower portions to be received by the T-shaped recesses of the ring, while the base, pressing nut and the cover are thread-jointed.

BRIEF DESCRIPTION OF THE DRAWINGS

Hereinafter the offered invention will be described by way of concrete examples of its embodiment with reference to the accompanying drawings of which.

PREFERRED EMBODIMENT OF THE INVENTION

Figure 1:
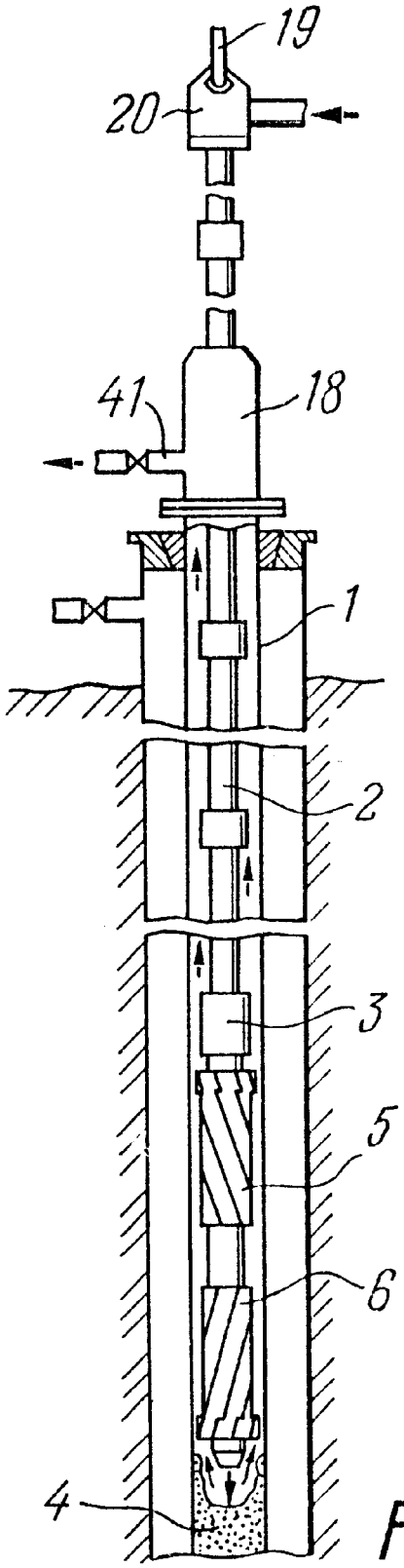
FIG. 1 is a elevational view, showing a device for regaining well mud circulation with the use of a pipe string comprised of separate pipe sections.

A method for regaining well mud circulation in conformity with the invention consists in the following. Run into a well, e.g., in tubing 1, is a hydromechanical cleaner 3 on a pipe string 2. Bridge 4 is washed out by direct effect of the descending flow of drilling mud injected through the pipe string 2. The hydromechanical cleaner 3, as the bridge is washed out, is moved downward by the moving pipe string 2. Bridge material 4 is mechanically removed from the well walls (inner surface of tubing 1) by rotation of scraper elements of hydromechanical cleaner 3. Scraper elements of hydromechanical cleaner 3 are rotated to mechanically remove bridge deposits 4 from well walls (inner surfaces of tubing 1) and the cleaned material is disposed from the well by the ascending flow of drilling mud. Mechanical removal of deposits from well walls (inner surface of tubing 1) is effected both, during running hydromechanical cleaner 3 into the well and also in the course of its lifting from the well.

A device used for embodiment of the method for regaining well mud circulation in conformity with the invention, e.g., in cleaning the tubing 1, comprises a hydromechanical Cleaner 3 connected to a pipe string 2 and acting on the bridge 4 and deposits on the walls of tubing 1. Scraper elements of the hydromechanical cleaner 3 are made in the form of at least two cleaning heads 5 and 6 with cutting knives on their outer surface. Cleaning heads 5 and 6 are installed so that they can freely rotate to opposite sides relative to each other in the mud flow. Free rotation of the cleaning heads 5 and 6 is promoted by the fact that they are installed on a body 8 and supported in radial thrust bearings 9 found in annular recesses made in eyed faces of the cleaning heads 5 and 6. From the outside, bearings 9 are covered by protective skirts 10. Installed between the cleaning heads 5 and 6 is a separating sleeve 11. Fixed in the lower portion of the body 8 is a removable support 12. Protective skirts 10 between the lower end face of the cleaning head 5 and the upper end face of the lower cleaning head 6 are made on the separating sleeve 11. The protective skirt 10 covering bearing 9 located in the annular recess of the upper end face of upper Cleaning head 5 is made in the body 8, and the protective skirt 10 covering bearing 9 is found in the annular recess of the lower end face of lower cleaning head 6 and arranged in the removable support 12. Cutting knives 7 of cleaning heads 5 and 6 are of an involute profile and the upper portion of upper cleaning head 5 and the lower portion of lower cleaning head 6 are provided with cutting edges 13. The height H of each cleaning head 5 or 6 is determined by the relation:

$$H=D/2tg\alpha$$

where D is the outer diameter of the cleaning head; and $\alpha$ is the angle of inclination of the cutting knife relative to the longitudinal axis of the cleaning head (knife angle).

Figure 2:
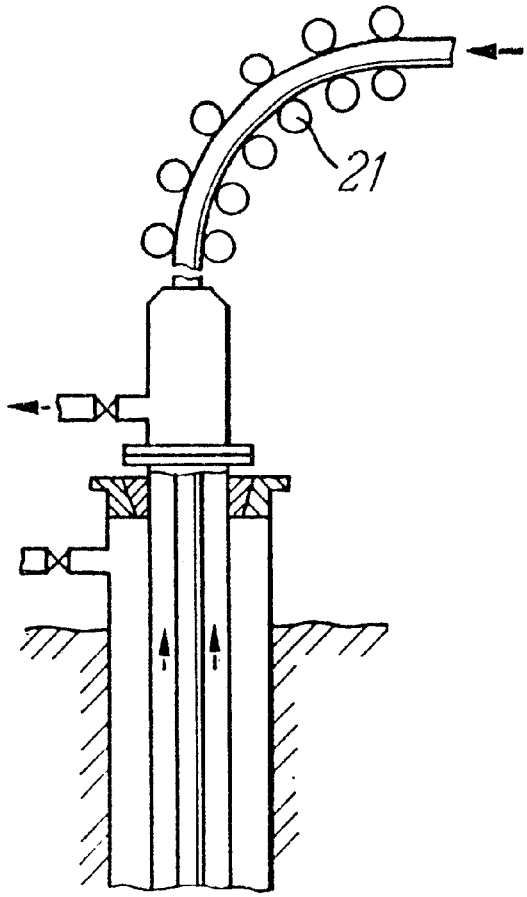
FIG. 2 is an enlarged elevational view, showing a device for regaining well mud circulation with the use of a continuous pipe string.
Figure 3:
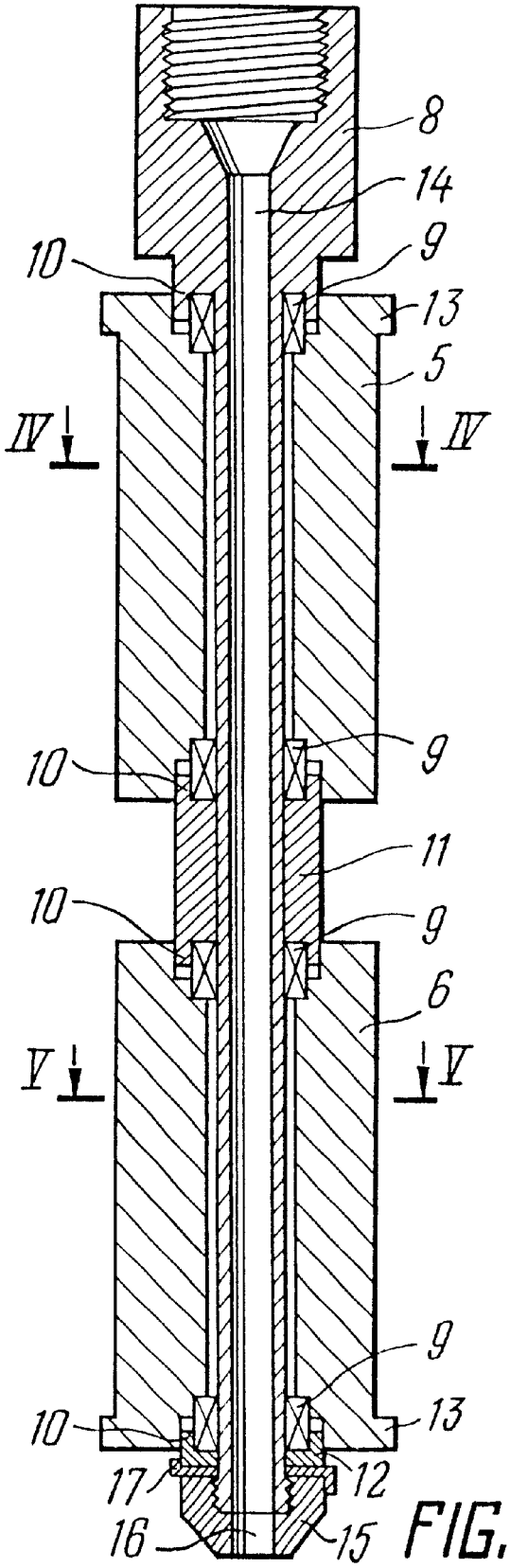
FIG. 3 is a longitudinal section of a hydromechanical cleaner in conformity with the invention.
Figure 4:
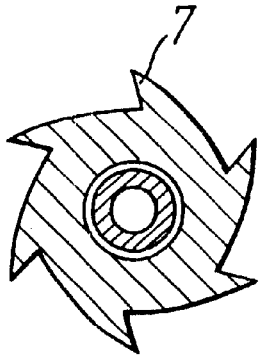
FIG. 4 is a cross-sectional view, taken along line IV—IV of FIG. 3 in conformity with the invention.
Figure 5:
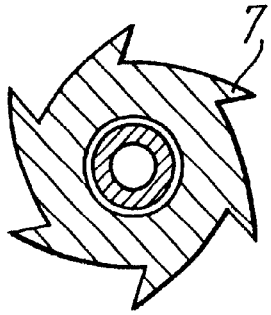
FIG. 5 is a cross-sectional view, taken along line V—V of FIG. 3 in conformity with the invention.
Figure 6:
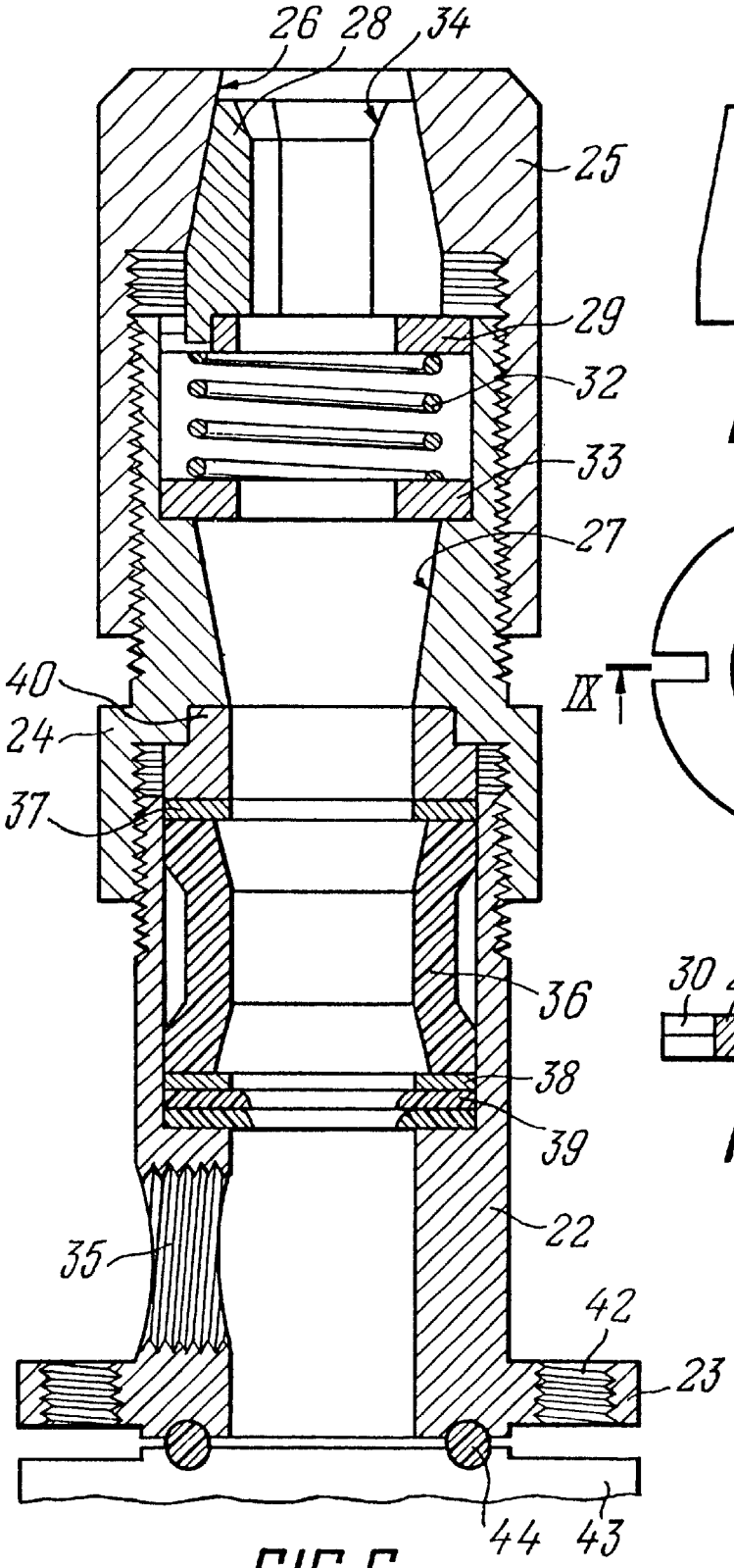
FIG. 6 is a longitudinal section of a wellhead circulating head in conformity with the invention.
Figure 7:
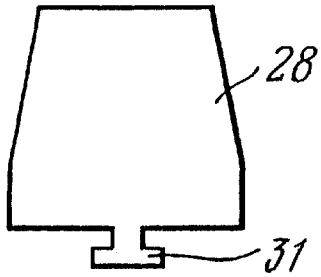
FIG. 7 is a rear view of slips in conformity with the invention.
Figure 8:
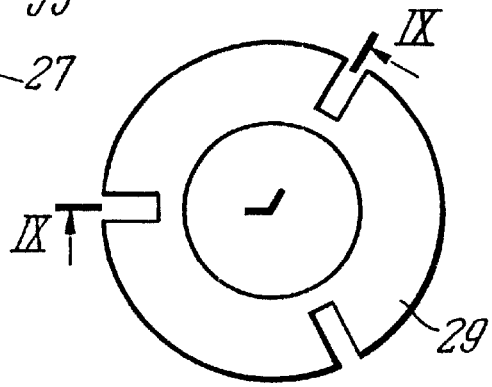
FIG. 8 is a top view of a ring in formity with the invention.
Figure 9:
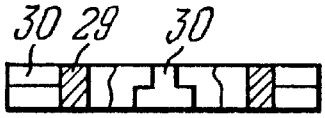
FIG. 9 is a cross-sectional view, taken along line IX—IX of FIG. 8 combined with a view of the ring T-shaped recess in conformity with the invention.

Separating sleeve 11 has a diameter which is smaller than the outer diameter of the cleaning heads 5 or 6. The body 8 of hydromechanical cleaner 2 has a through axial channel 14 and the lower portion of the body 8 has an outer thread on which nut 15 with nozzle 16 is screwed. Installed between the nut 15 and the removable support 12 is a lock washer 17, which prevents rotation of the removable support 12 relative to the body 8 and the nut 7, and also from spontaneous unscrewing of the latter. Pipe string 2 passes through the wellhead circulating head 18 and is connected with its upper end to a pump unit (not shown). There is a mechanism (not shown) for moving the pipe string 2. Used as pipe string 2 may be a string of pipes provided with box and pin joints, and, in this case, used as a mechanism for moving pipe string 2 may be, e.g., a well repair unit provided with pulley-block system 19 connected with eye-bolt swivel 20 (FIG. 1), and a means for making and breaking pipe string 2. In case of a continuous pipe string 2, a mechanism for its moving is usually used in the form of units with a steel pipe wound on a drum moved by feed mechanism 21 (FIG. 2). Wellhead circulating head. 18 (FIG. 6) has a body comprising base 22 with flange 23, pressing nut 24 and cover 25 successively arranged and interconnected so that they may be disassembled and adjusted in height relative to each other. In a concrete embodiments they are threadconnected. Cover 25 has a taper recess 26. Pressing nut 24 also has a taper recess 27 reverse to taper recess 26 of the cover 25. Taper recess 26 of cover 25 accommodates slips 28 which are installed with their lower portions in ring 29 with possibility of radial motion relative to the latter and synchronous axial motion together with it in taper recess 26 of cover 25. Such a motion of slips 28 in a particular case may be ensured due to the fact that ring 29 has radial T-shaped recesses 30 (FIG. 9), while lower portions of the slips 28 have T-shaped shanks 31 (FIG. 7) to be received in said T-shaped recesses 30. Ring 29 is spring-loaded by spring 32 relative to the pressing nut 24. Installed between the spring 32 and the pressing nut 24 is a thust washer 33 made in the form of a ring interchangeable with ring 29 connecting slips 28. In their turn, slips 28 may be reinstalled into thrust washer 11 to be accommodated in taper recess 27 of pressing nut 24. Slips 28 have internal bevels in their upper portions. Located in base 22 above side branch 35 is a sealing unit which may be made in a concrete embodiment in the form of a seal 36 disposed between the upper and lower bearing disks 37 and 38, collars 39 installed between lower bearing disk 38 and base 22, and box 40 installed on the upper bearing disk 37 with a possibility of interacting with pressing nut 24. Side branch 35 is made in form of a threaded hole to receive branch pipe 41. Flange 23 may have threaded holes 42 to receive studs (not shown) to connect flange 43 to e.g., a Christmas tree. Located between flanges 23 and 43 is a seal ring 44.

Operation of the device for regaining well mud circulation is explained by an example of cleaning a tubing with the use of a hydromechanical cleaner having two cleaning heads.

The device operates as follows. At the well-head, the lower portion of the pipe 2 is passed through the wellhead circulating head 18, which has not been yet connected to the flange 43. 35 Slips 28 do not interfere with motion of pipe 2 as pipe 2 slides in them. Then, the hydromechanical cleaner 3 is connected to the lower end of the pipe 2 and directed into the tubing 1, which, in particular, is to be cleaned, and the wellhead circulating head 18 is lowered on to flange 43. Flanges 23 and 43 are connected to each other. Connected to the upper end of pipe 2 is eye-bolt swivel 20 communicated with a pump unit. Supply of drilling mud is started and the assembled unit is lowered with the use of a pulley-block system 19 of a well repair unit. Eye-bolt swivel 20 may be used in the form of the known design described, e.g., in the USSR patent No. 1,506,667. When eye-bolt swivel 20 reaches its extreme lower position, supply of drilling mud is discontinued, and a next pipe 2 is added with the use of means for making and breaking and holding pipes 2 included in the well repair unit. Eye-bolt swivel 20 is connected again, mud supply is resumed and pipe string 2 at a definite speed is run into the well, and so on, until reaching the required depth for cleaning. Mud is supplied through axial channel 14 of the body 8 of the hydromechanical cleaner 3, and mud leaving nozzle 16 in the form of a jet acts on the bridge 40 to wash it out. Drilling mud is enriched with bridge products (sludge) 40 and is forced along the annulus towards the wellhead to side branch 35 and disposed through branch pipe 41 to a sludge collection site. Ascending flow of drilling mud acts on involute surfaces of cutting knives 7 to make them rotate in opposite direction to each other. The cutting knives 7 cut deposits off the walls of tubing 1 (in the given cate). Hydromechanical cleaner 3 is moved as the bridge 4 and wall deposits are washed out. The force of pressing the sealing unit 36 to pipes 20 is adjusted by the pressing nut 24. In case of exposure of an oil or gas formation in tubing 1 and occurrence of a high pressure, the assembly unit will be prevented from ejection by means of slips 28. Availability of internal bevels 34 on slips upper portions provides for unobstructed passing of box-pin joints during running of the pipe string 2 into the well.

The device is also operable at a constant high pressure in the well. In this case, the well repair unit should be provided with a mechanism for forced lowering of pipes 2. Upon reaching the depth of required cleaning, the hydromechanical cleaner 3 is kept for a moment in this position to fully remove sludge by continuous supply Of mud. Then, supply of mud is discontinued, cover 25 is unscrewed and slips 28 are removed from ring 29 and reinstalled into thrust bushing 33 to be arranged in the inner taper recess 27 of pressing nut 24. Then, cover 25 is screwed on to press ring 29. In so doing, the slips 8 do not interfere with lifting of the pipes 2, as the latter slide freely in them and can function as a spider. In the course of lifting the cleaning assembly unit, drilling mud is supplied continuously to provide for repeated mechanical removal of deposits from walls. Repeated mechanical removal of sludge from walls may be accomplished as well without supply of drilling mud, provided mud circulation is regained and cleaning heads 5 and 6 are rotated by the flow of well products in the course of lifting of the hydromechanical cleaner. At the end of lifting of hydromechanical cleaner 3, before disconnection of the wellhead circulating head 18, the well is squeezed, if it is required, with subsequent putting of the well on production.

A specific feature of application of the continuous pipe string 2 (besides the u'se of the unit with a steel pipe wound on the drum moved by feed mechanism 21) is., as a rule, absence of slips 28 in wellhead circulating head 18, which are preliminarily removed as they are not needed, because feed mechanism 21 at any stage of work involved in regaining circulation, under any conditions) ensures holding of the cleaning assembly unit in the well. Drilling mud is supplied through the continuous pipe string 2 by a pump unit communicated with the upper end of this continuous pipe string 2. Further on, the process of regaining mud circulation in the well is carried out as specified above.

What is claimed is:

1. A method for regaining drilling mud circulation in a well comprising the steps of introducing a hydromechanical cleaner with scraper elements into a tubing of a well by means of a pipe string; injecting drilling mud through said pipe string and out from a distal end of said pipe string at a bridge in said well; breaking up said bridge by means of a jet action caused by a flow of said drilling mud out from said pipe string; and removal of deposits from walls of said well by means of rotation of said scraper elements of said hydromechanical cleaner and by an ascending flow of said drilling mud.

2. A device for regaining circulation of drilling mud in a well comprising:

a tubing extending into said well;

a pipe string with an axial channel and said pipe string being positioned within said tubing;

hydromechanical cleaners with scraper elements and an axial channel and said hydromechanical cleaners being mounted on said pipe string;

means for moving said pipe string within said tubing;

a nozzle positioned on a distal end of said pipe string;

a pump unit for injection of drilling mud through said pipe string and out through said nozzle; and, a well head circulating head through which said pipe string passes.

3. A device according to claim 2, wherein said hydromechanical cleaners include cleaning heads with cutting knives on an outer surface of said cleaning heads, and wherein the height of each cleaning head is determined by the relation:

$$H=D/2 \text{ tangent}\alpha$$

where D is an outer diameter of the cleaning head;

and $\alpha$ is the angle of inclination of the cutting knife relative to a longitudinal axis of the cleaning head.

4. A device according to claim 3, wherein said cutting knives of said cleaning heads of said hydromechanical cleaner have an involute profile.

5. A device according to claim 3, wherein said hydromechanical cleaner further comprises: a body affixed to said pipe string; upper and lower cleaning heads supported on said body; radial thrust bearings supporting said cleaning heads on said body and said radial thrust bearings being supported in annular recesses in said cleaning heads; protective skirts positioned over said radial thrust bearings; a separating sleeve installed between said upper and lower cleaning heads and supported on said body; a removable support affixed on a lower end of said body; said nozzle positioned on said removable support of said body; and a nut and lock washer to affix said nozzle and said movable support to a lower end of said body.

6. A device according to claim 2, wherein said wellhead circulating head comprises a base with a flange, a pressing nut and a cover successfully arranged and interconnected so that they may be dissembled and adjusted in height relative to each other.

7. A device according to claim 6, further comprising a ring positioned within said cover of said wellhead circulating head; slips installed in said cover with lower portions of said slips installed in said ring, and said slips moving radially relative to said ring and axially moved in synchronism with said ring within said cover; a side branch connected to said base of said wellhead circulating head; a sealing unit located in said base of said wellhead circulating head and above said side branch; a spring positioned within said wellhead circulating head between said ring and said pressing nut; and a thrust washer installed within said wellhead circulating head between said spring and said pressing nuts.

8. A device according to claim 7 wherein said sealing unit of said wellhead circulating head includes upper and lower bearing disks, a seal located between said upper and lower bearing disks, collars installed between said lower bearing disk and said base, and a box installed on said upper bearing disk and said box interacting with said pressing nut.

9. A device according to claim 7, wherein said ring has outer radial T-shaped recesses and said slips have T-shaped shanks, and wherein T-shaped shanks of said slips can be received within said T-shaped recess of said ring.

* * * * *